US008459048B2

(12) United States Patent
Eisenhour

(10) Patent No.: US 8,459,048 B2
(45) Date of Patent: Jun. 11, 2013

(54) GEROTOR EXPANDER FOR AN AIR CONDITIONING SYSTEM

(75) Inventor: Ronald S. Eisenhour, West Bloomfield, MI (US)

(73) Assignee: Nissan North America, Inc., Franklin, TN (US)

( * ) Notice: Subject to any disclaimer, the term of this patent is extended or adjusted under 35 U.S.C. 154(b) by 467 days.

(21) Appl. No.: 12/842,296

(22) Filed: Jul. 23, 2010

(65) Prior Publication Data

US 2012/0017635 A1 Jan. 26, 2012

(51) Int. Cl.
*F25B 9/00* (2006.01)
*F25D 9/00* (2006.01)

(52) U.S. Cl.
USPC ..... 62/87; 62/402

(58) Field of Classification Search
USPC ..... 62/87, 239, 244, 299, 401, 402, 498, 62/511; 418/61.3, 166, 177
See application file for complete search history.

(56) References Cited

U.S. PATENT DOCUMENTS

| | | | | |
|---|---|---|---|---|
| 4,767,292 | A * | 8/1988 | Kinder | 418/2 |
| 5,722,815 | A | 3/1998 | Cozens | |
| 5,910,100 | A * | 6/1999 | Hooper | 60/651 |
| 6,272,871 | B1 * | 8/2001 | Eisenhour | 62/225 |
| 6,336,317 | B1 * | 1/2002 | Holtzapple et al. | 60/39.63 |
| 6,604,378 | B2 | 8/2003 | Clodic | |
| 6,655,165 | B1 | 12/2003 | Eisenhour | |
| 6,739,141 | B1 | 5/2004 | Sienel et al. | |
| 6,854,283 | B2 | 2/2005 | Nakatani et al. | |
| 6,877,340 | B2 | 4/2005 | Hiwata et al. | |
| 7,178,358 | B2 | 2/2007 | Inaba et al. | |
| 7,313,926 | B2 | 1/2008 | Gurin | |
| 7,334,428 | B2 | 2/2008 | Holdsworth | |
| 7,603,861 | B2 | 10/2009 | Santa Cruz et al. | |
| 7,607,314 | B2 | 10/2009 | Eisenhour | |

FOREIGN PATENT DOCUMENTS

| | | |
|---|---|---|
| DE | 4338677 A1 | 8/1994 |
| JP | 11-063707 A | 3/1999 |

* cited by examiner

*Primary Examiner* — Cheryl J Tyler
*Assistant Examiner* — Elizabeth Martin
(74) *Attorney, Agent, or Firm* — Global IP Counselors, LLP

(57) ABSTRACT

An air conditioning system is provided with mainly an evaporator, a compressor, a condenser and an energy recovery device. The compressor is fluidly connected to the evaporator to compress low-pressure refrigerant exiting the evaporator to high-pressure refrigerant. The condenser is fluidly connected to the compressor to receive the high pressure refrigerant and dissipate heat therefrom. The energy recovery device is configured to extract work from refrigerant flowing therethrough. The energy recovery device includes a movable expander and a valve. The movable expander has an inlet fluidly connected to the condenser to receive high pressure refrigerant exiting the condenser, an outlet fluidly connected to the evaporator to deliver low pressure refrigerant thereto and a chamber fluidly connected between the inlet and the outlet. The valve is configured to control a flow rate of high pressure refrigerant flowing from the inlet to the chamber.

19 Claims, 9 Drawing Sheets

GEROTOR EXPANDER FOR AN AIR CONDITIONING SYSTEM

BACKGROUND

1. Technical Field

The present invention relates to an air conditioning system. More specifically, the present invention relates to an air conditioning system with an energy recovery device that extracts work from expanding refrigerant moving from a high-pressure zone to a lower pressure zone of the air conditioning system.

2. Background Information

Vehicle air conditioning systems utilize the phase changes of refrigerant fluids in order to extract heat from circulated air, and thus cool the air. A typical vehicle air conditioning system includes a compressor, a condenser, an expansion valve and an evaporator. The compressor compresses a cool vapor-phase refrigerant (e.g., Freon, R134a) to heat the same, resulting in a hot, high-pressure vapor-phase refrigerant. This hot vapor-phase refrigerant runs through a condenser, typically a coil that dissipates heat. The condenser condenses the hot vapor-phase refrigerant into liquid refrigerant. The liquid refrigerant is regulated through the expansion valve, which evaporates the refrigerant to a cold, low-pressure saturated liquid-vapor-phase refrigerant. This cold saturated liquid-vapor-phase refrigerant runs through the evaporator, typically a coil that absorbs heat from the air fed to the passenger compartment.

Basically, the input energy for a vehicle air conditioning system is typically represented by the power required to operate the compressor that compresses refrigerant vapor. Much of the energy added to the system through the compression process is expelled as kinetic energy during the expansion phase when the pressure of the refrigerant rapidly drops. In order to increase the efficiency of refrigeration systems, attempts have been made to recover some of the energy released during the expansion process and to convert the recovered energy into useful work. For example, one proposal to improve energy efficiency of a vehicle air conditioning system is disclosed in U.S. Pat. No. 6,272,871. Generally, in this patent, the air conditioning system is provided with an energy recovery device that recovers energy generated during operation of the air conditioning system. Specifically, the air conditioning system utilizes a vane-type expander (similar to a vane type compressor, but operating in reverse) to extract energy from normal operation of the air conditioning system. In this air conditioning system, the expanding refrigerant is used to rotate the vane-type expander that is connected to a shaft from which mechanical and/or electrical energy can be extracted.

SUMMARY

It has been discovered that air conditioning systems employing rotating expansion devices (such as vane-type expanders configured as energy recovery devices) may exhibit suction losses, which can impede rotational motion and reduce efficiency. The geometries of some vane-type expanders can also cause expanded refrigerant to be partially re-compressed before exiting the expander. Additionally, the high number and complexity of parts that comprise vane-type expanders introduces additional cost and potential points of failure.

In view of these operational limitations of rotating expansion devices such as vane-type expanders, one aspect of the present invention is to utilize a movable expander in an air conditioning system that can reduce and/or eliminate the suction loss that occurs in energy recovery devices that utilize a vane-type expander in an air conditioning system.

In view of the state of the known technology, another aspect of the present invention is to provide an air conditioning system that mainly comprises an evaporator, a compressor, a condenser, a valve and an energy recovery device. The compressor is fluidly connected to the evaporator to compress low-pressure refrigerant exiting the evaporator to high-pressure refrigerant. The condenser is fluidly connected to the compressor to receive the high pressure refrigerant and dissipate heat therefrom. The energy recovery device is configured to extract work from refrigerant flowing therethrough. The energy recovery device includes a gerotor expander and a valve. The gerotor expander has an inlet fluidly connected to the condenser to receive high pressure refrigerant exiting the condenser, an outlet fluidly connected to the evaporator to deliver low pressure refrigerant thereto and a chamber fluidly connected between the inlet and the outlet. The valve is configured to control a flow rate of high pressure refrigerant flowing from the inlet to the chamber. The chamber includes a center gear and a ring gear, with a rotation axis of the center gear being offset from a rotation axis of the ring gear such that rotational movement of the ring gear drives the center gear.

In view of the state of the known technology, another aspect of the present invention is to provide an air conditioning system that mainly comprises an evaporator, a compressor, a condenser, a valve and an energy recovery device. The compressor is fluidly connected to the evaporator to compress low-pressure refrigerant exiting the evaporator to high-pressure refrigerant. The condenser is fluidly connected to the compressor to receive the high pressure refrigerant and dissipate heat therefrom. The energy recovery device is configured to extract work from refrigerant flowing therethrough. The energy recovery device includes a movable expander and a valve. The movable expander has an inlet fluidly connected to the condenser to receive high pressure refrigerant exiting the condenser, an outlet fluidly connected to the evaporator to deliver low pressure refrigerant thereto and a chamber fluidly connected between the inlet and the outlet. The movable expander further includes a minimum flow path and a regulated flow path. The minimum flow path fluidly connects the inlet to the chamber at a first flow interface to deliver high pressure refrigerant to the chamber. The regulated flow path fluidly connects the inlet to the chamber at a second flow interface downstream from the first flow interface and upstream from the outlet to deliver high pressure refrigerant to the chamber at the second flow interface.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
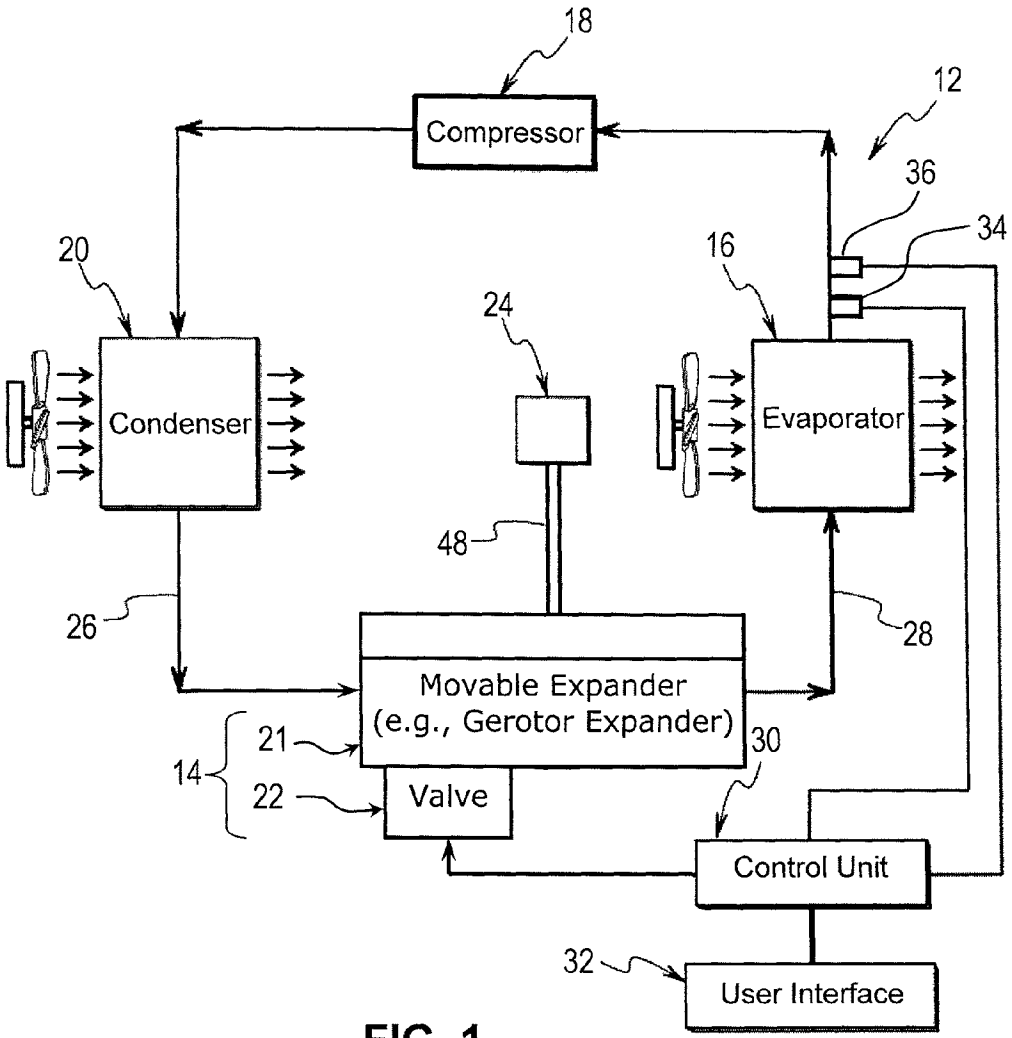
FIG. 1 is a schematic system diagram of a vehicle air conditioning system equipped with an energy recovery device in accordance with an illustrated embodiment.

Referring initially to FIG. 1, a vehicle air conditioning system 12 is equipped with an energy recovery device 14 in accordance with an illustrated embodiment. The energy recovery device 14 extracts energy (work) from expansion of refrigerant as the refrigerant moves from a high-pressure zone of the air conditioning system 12 to a low-pressure zone of the air conditioning system 12. As shown schematically in FIG. 1, in addition to the energy recovery device 14, the air conditioning system 12 also includes an evaporator 16, a compressor 18 and a condenser 20.

In the illustrated embodiment, the energy recovery device 14 basically includes a movable expander 21 and a valve 22. More particularly, in the illustrated embodiment, the movable expander 21 is a gerotor expander. The movable expander 21 is configured and arranged to extract energy (work) from expansion of the refrigerant as the refrigerant moves from a high-pressure zone of the air conditioning system 12 to a low-pressure zone of the air conditioning system 12. While the air conditioning system 12 is especially suitable for use in a motor powered vehicle as illustrated, the air conditioning system 12 is also suitable for use in a stationary heat pump/air conditioning system.

Figure 2:
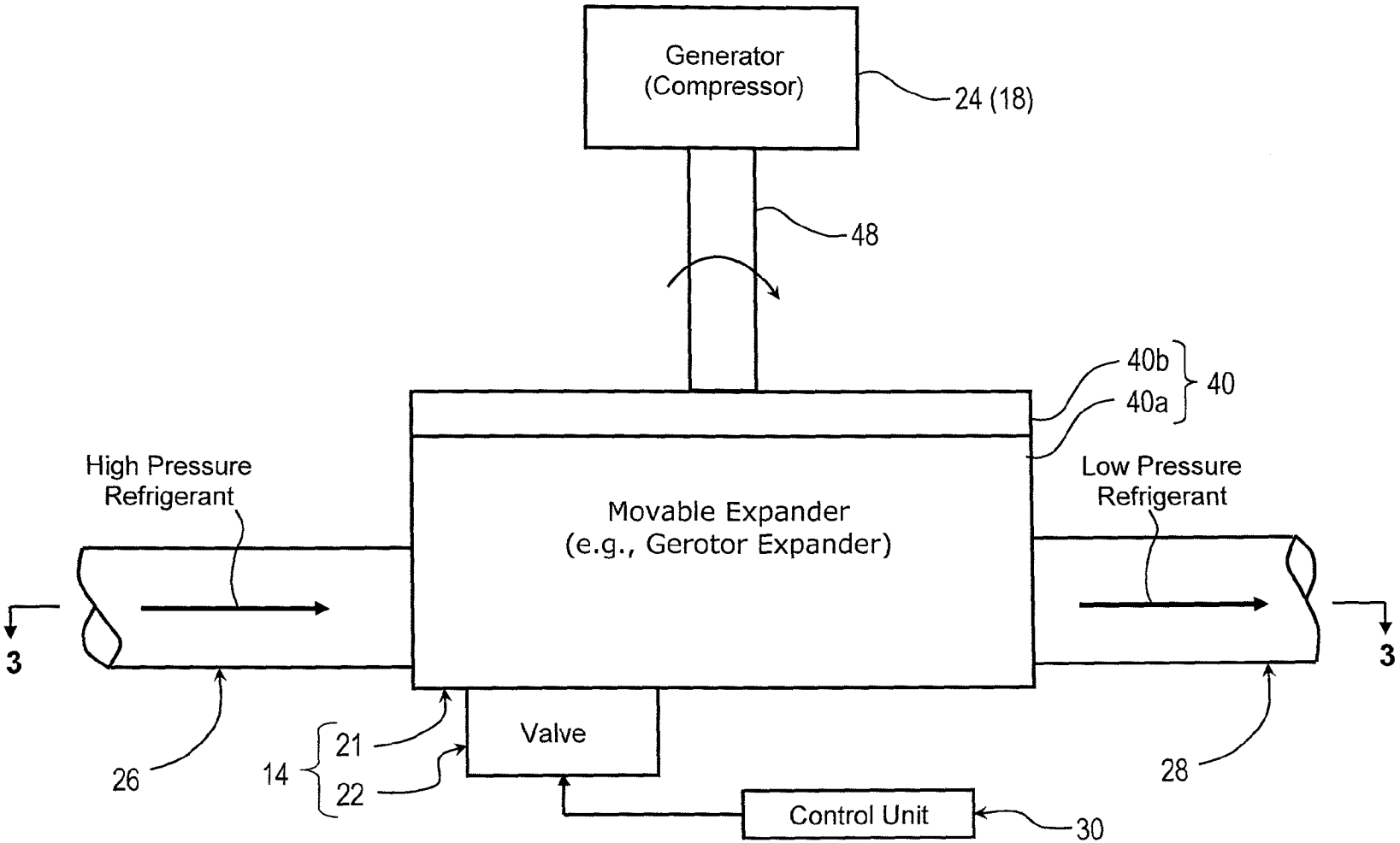
FIG. 2 is a simplified schematic view of the energy recovery device including a movable (gerotor) expander and a valve.
Figure 3:
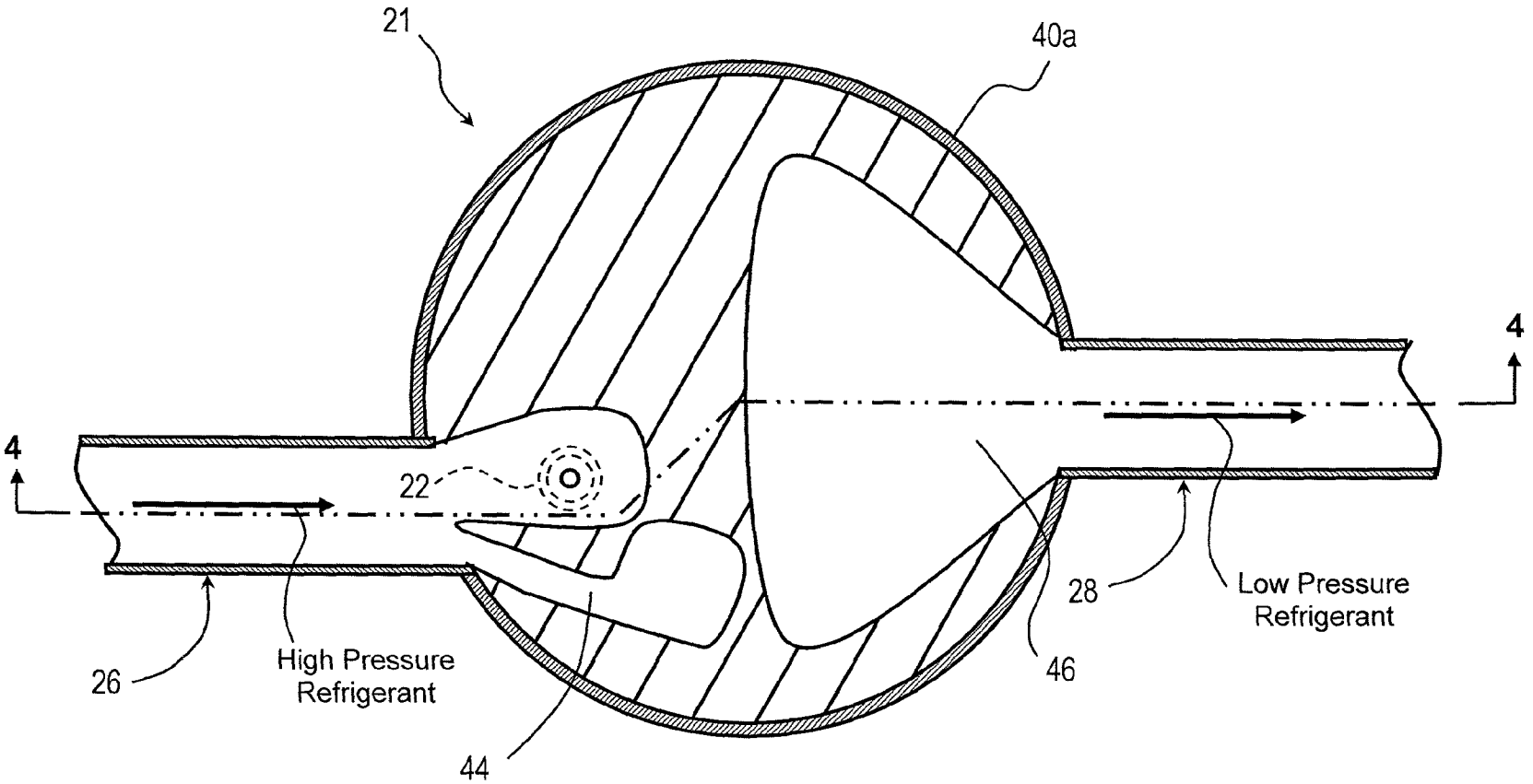
FIG. 3 is a simplified cross sectional view of the movable expander as seen along section line 3-3 in FIG. 2 showing the high pressure line entering the movable expander and the low pressure line exiting the movable expander.
Figure 4:
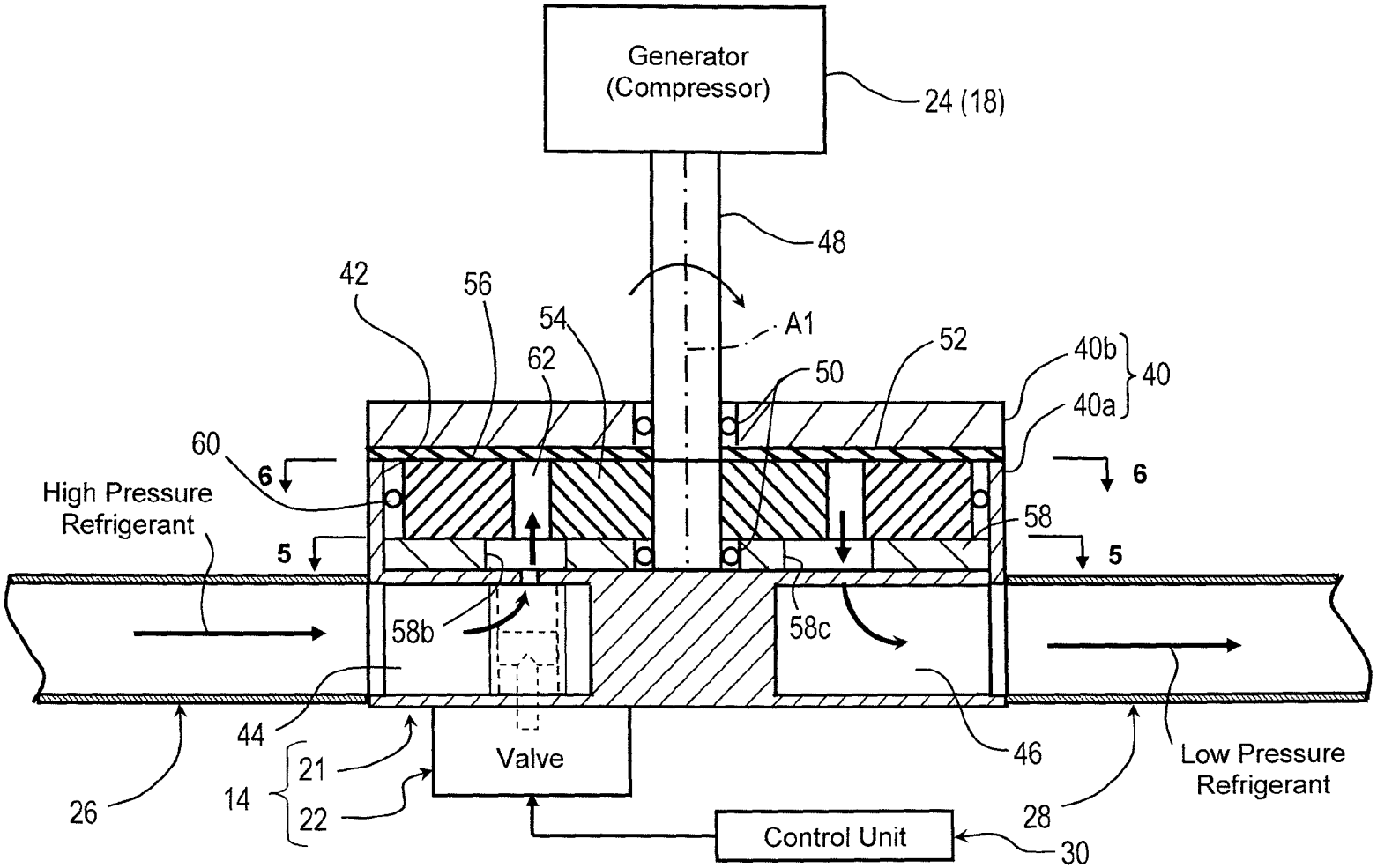
FIG. 4 is a simplified cross sectional view of the movable expander as seen along section line 4-4 in FIG. 3 showing the flow path of refrigerant through the movable expander.
Figure 5:
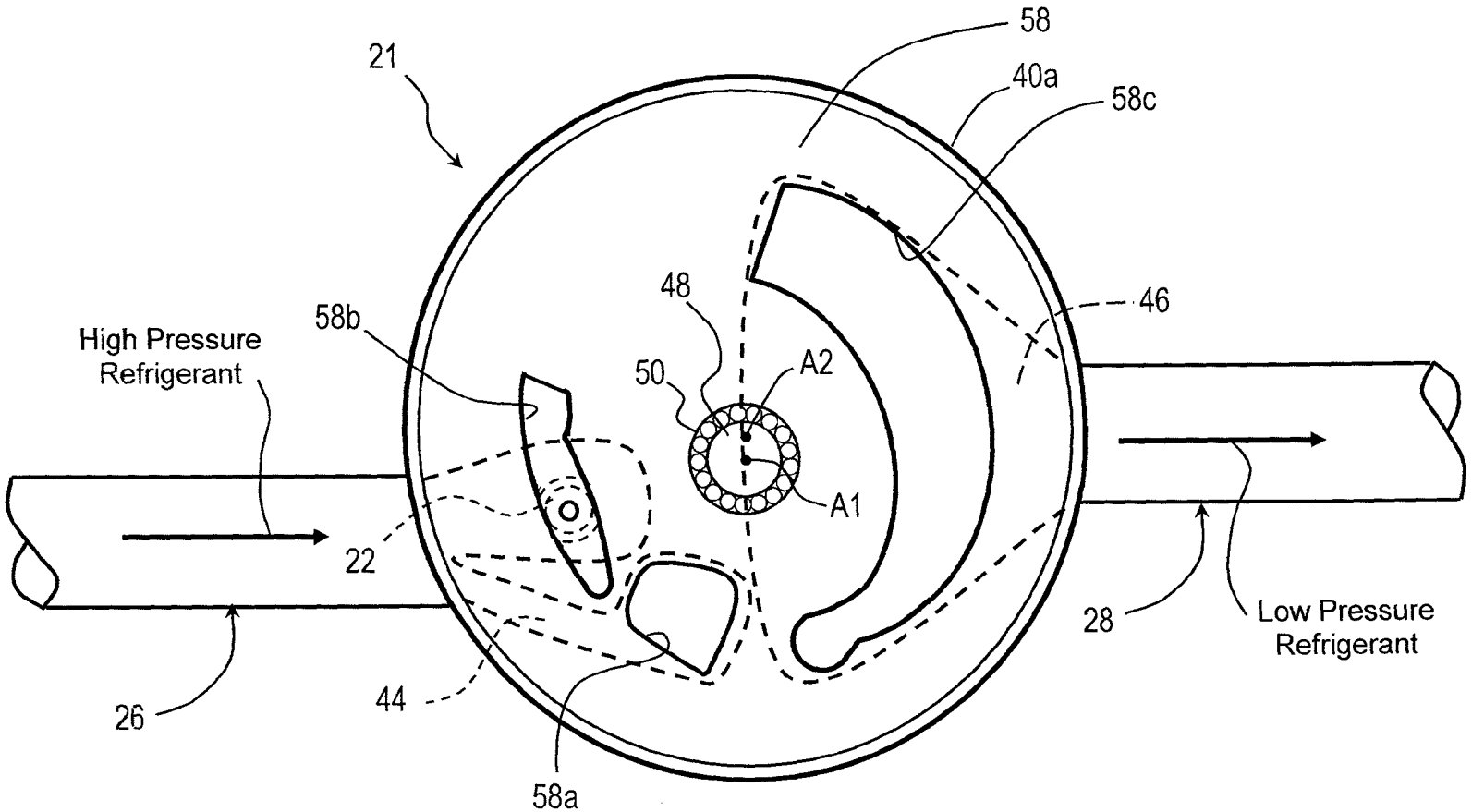
FIG. 5 is a simplified cross sectional view of the movable expander as seen along section line 5-5 in FIG. 3 showing a flow plate that separates the minimum flow path, the regulated flow path, and the exit flow path from expansion cavities.

In the illustrated embodiment of FIGS. 1, 2 and 4, a generator 24 is driven by the energy recovery device 14 to produce electricity which is stored in a battery (not shown). While the generator 24 is illustrated as being rotated by the energy recovered by the energy recovery device 14, it will be apparent to those skilled in the air conditioning field that the energy recovered by the energy recovery device 14 can be used to rotate other devices as needed and/or desired, depending on the application of the air conditioning system 12. For example, as diagrammatically illustrated in FIGS. 2 and 4, alternatively, the energy recovery device 14 is operatively coupled to the compressor 18 to transfer work from expanding refrigerant flowing through the energy recovery device 14 to the compressor 18.

The components of the vehicle air conditioning system 12 will now be described in more detail. Basically, the energy recovery device 14 and the compressor 18 divide the refrigerant circuit into a high pressure line 26 and a low pressure line 28. The evaporator 16 is disposed in the low pressure line 28, while the condenser 20 is disposed in a high pressure line 26. The compressor 18 is disposed between the beginning of the high pressure line 26 and the end of the low pressure line 28. The energy recovery device 14 is disposed between the end of the high pressure line 26 and the beginning of the low pressure line 28. Thus, the outlet side of the energy recovery device 14, the low pressure line 28 with the evaporator 16, and the inlet side of the compressor 18 generally define a low-pressure zone of the air conditioning system 12. On the other hand, the outlet side of compressor 18, the high pressure line 26 with the condenser 20, and the valve 22 generally define a high-pressure zone of the air conditioning system 12.

The evaporator 16 is a conventional element of the air conditioning system 12 and serves to absorb heat outside the evaporator 16. The evaporator 16 can include a blower or fan which forces air past the evaporator 16 for improved heat transfer. Heat in the moving air is in turn absorbed by low-pressure refrigerant within the evaporator 16. Optimally, the refrigerant within the evaporator 16 is in a liquid-vapor state and exits in the vapor state after absorbing heat. The low pressure line 28 fluidly connects the energy recovery device 14 to the evaporator 16 and also fluidly connects the evaporator 16 to the compressor 18.

The compressor 18 is fluidly connected to the evaporator 16 to compress low-pressure refrigerant exiting the evaporator 16 to high-pressure refrigerant that is directed to the condenser 20. In other words, the low-pressure refrigerant exiting the evaporator 16 is directed to the compressor 18 via the low pressure line 28. The compressor 18 preferably compresses the refrigerant in a conventional manner into high-pressure refrigerant in the vapor state. The high-pressure refrigerant compressed by the compressor 18 exits the compressor 18 via the high pressure line 26. Thus, the high pressure line 26 is further fluidly connected to the condenser 20 in a conventional manner.

As mentioned above, the condenser 20 is fluidly connected to the compressor 18 to receive the high pressure refrigerant and dissipate heat therefrom. The condenser 20 can include a blower or fan that forces air past the condenser 20 for improved heat transfer. Hence, the high-pressure refrigerant within the condenser 20 is cooled by airflow in a conventional manner. The cooled high-pressure refrigerant is then directed to the valve 22 via the high pressure line 26, in a conventional manner. By opening and closing the valve 22, the valve 22 effectively controls the flow of high pressure refrigerant exiting the condenser 20 to the energy recovery device 14.

The air conditioning system 12 further includes a control unit 30 for controlling the opening and closing of the valve 22. The control unit 30 is operatively connected to the valve 22 to control the flow rate of high pressure refrigerant exiting the condenser 20 and entering the movable expander 21 of the energy recovery device 14 based on at least one of pressure and temperature of the air conditioning system 12. The control unit 30 preferably includes a microcomputer with an air conditioning control program that controls the air conditioning system 12 in accordance with the air conditioning control program. The control unit 30 also preferably includes other conventional components such as an input interface circuit, an output interface circuit, and storage devices such as a ROM (Read Only Memory) device and a RAM (Random Access Memory) device. It will be apparent to those skilled in the art from this disclosure that the precise structure and algorithms for the control unit 30 can be any combination of hardware and software that will carry out the functions of the air conditioning system 12 as needed and/or desired.

In addition to the secondary function of controlling the valve 22, a primary function of the control unit 30 is to provide a cold evaporator temperature that is above the freezing point of water, while ensuring that the refrigerant entering the compressor 18 is in the vapor phase. This facilitates good compression behavior at the compressor 18 and A/C cooling performance.

A conventional user interface 32 is provided for allowing the user to input the desired settings that the control unit 30 uses to operate the components of the air conditioning system 12. In other words, the conventional user interface 32 is operatively coupled to the control unit 30 for the user to control the operation of the air conditioning system 12 in a conventional manner.

The air conditioning system 12 further includes a pressure sensor 34 and a temperature sensor 36. The control unit 30 is operatively connected to the pressure sensor 34 and the temperature sensor 36. The pressure sensor 34 and the temperature sensor 36 are, for example, mounted to the low pressure line 28 downstream of the evaporator 16. The pressure sensor 34 detects refrigerant pressure within the low pressure line 28. The temperature sensor 36 detects temperature pressure within the low pressure line 28. Signals from the pressure sensor 34 and the temperature sensor 36 are processed by the control unit 30. In response to measured pressure and/or temperature conditions, the control unit 30 opens and closes the valve 22 to maintain a desired pressure condition within the low pressure line 28 and/or desired temperature proximate the evaporator 16.

Turning now to FIGS. 2 to 7, the energy recovery device 14 of the illustrated embodiment will now be discussed in more detail. In the illustrated embodiment, the movable expander 21 is a gerotor expander. The movable expander 21 has a housing 40 with a gerotor expander chamber 42, an inlet 44 and an outlet 46. The inlet 44 fluidly connects the high pressure line 26 to the gerotor expander chamber 42, while the outlet 46 fluidly connects the low pressure line 28 to the gerotor expander chamber 42. A rotatable output shaft 48 is rotatably supported relative to the housing by a pair of shaft bearings 50. In the illustrated embodiment, the housing 40 includes a first housing part 40*a* and a second housing part 40*b*, with the rotatable output shaft 48 protruding out of the second housing part 40*b* for attachment to an input of a rotary device such as the generator 24 or the compressor 18. A seal 52 is provided between the first and second housing parts 40*a* and 40*b* to seal the interface therebetween and around the output shaft 48

Figure 6:
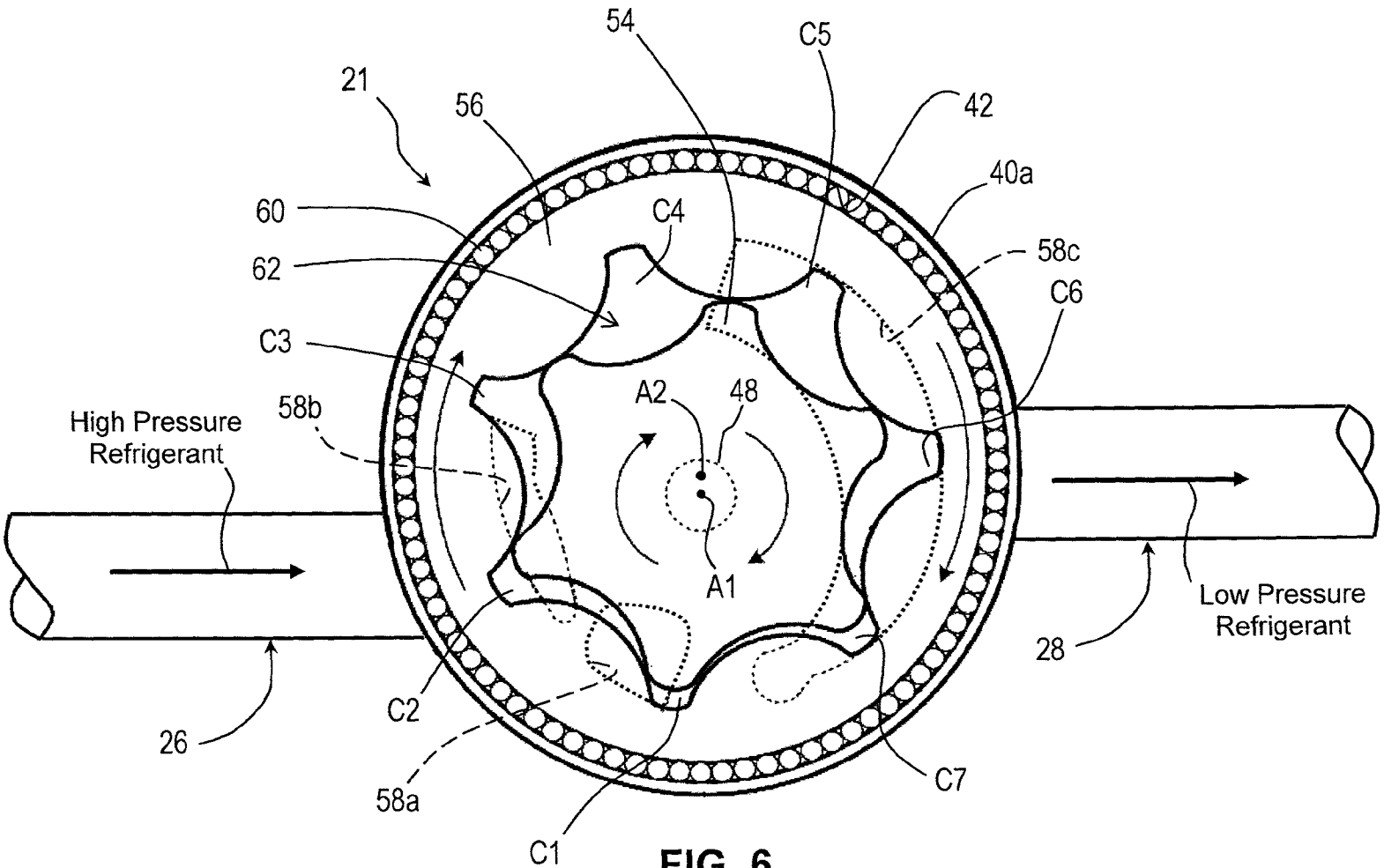
FIG. 6 is a simplified cross sectional view of the movable expander as seen along section line 6-6 in FIG. 3 showing a ring gear and a center gear that define expansion cavities in the movable expander.

Inside the gerotor expander chamber 42, the movable expander 21 is provided with a center gear 54, an outer ring gear 56 and a flow control plate 58. The rotatable output shaft 48 is fixedly connected to the center gear 54 so that they rotate together as a single unit. As seen in FIG. 6, the output shaft 48 extracts work from the movement of the movable expander 21 due to the refrigerant phase change and/or refrigerant pressure change in the movable expander 21, causing the output shaft 48 to turn, which in turn drives either the generator 24 or the compressor 18. Basically, the output shaft 48 is configured and arranged to extract the work from rotational movement of the center gear 54. In particular, the center gear 54 engages the outer ring gear 56 such that center gear 54 rotates the output shaft 48 in response to a phase change of the flow of refrigerant from the high pressure refrigerant at the inlet 44 to the low pressure refrigerant at the outlet 46. The center gear 54 and the outer ring gear 56 are disposed in the gerotor expander chamber 42 such that the center gear 54 has its axial end faces coplanar with respective axial end faces of the outer ring gear 56.

Figure 7:
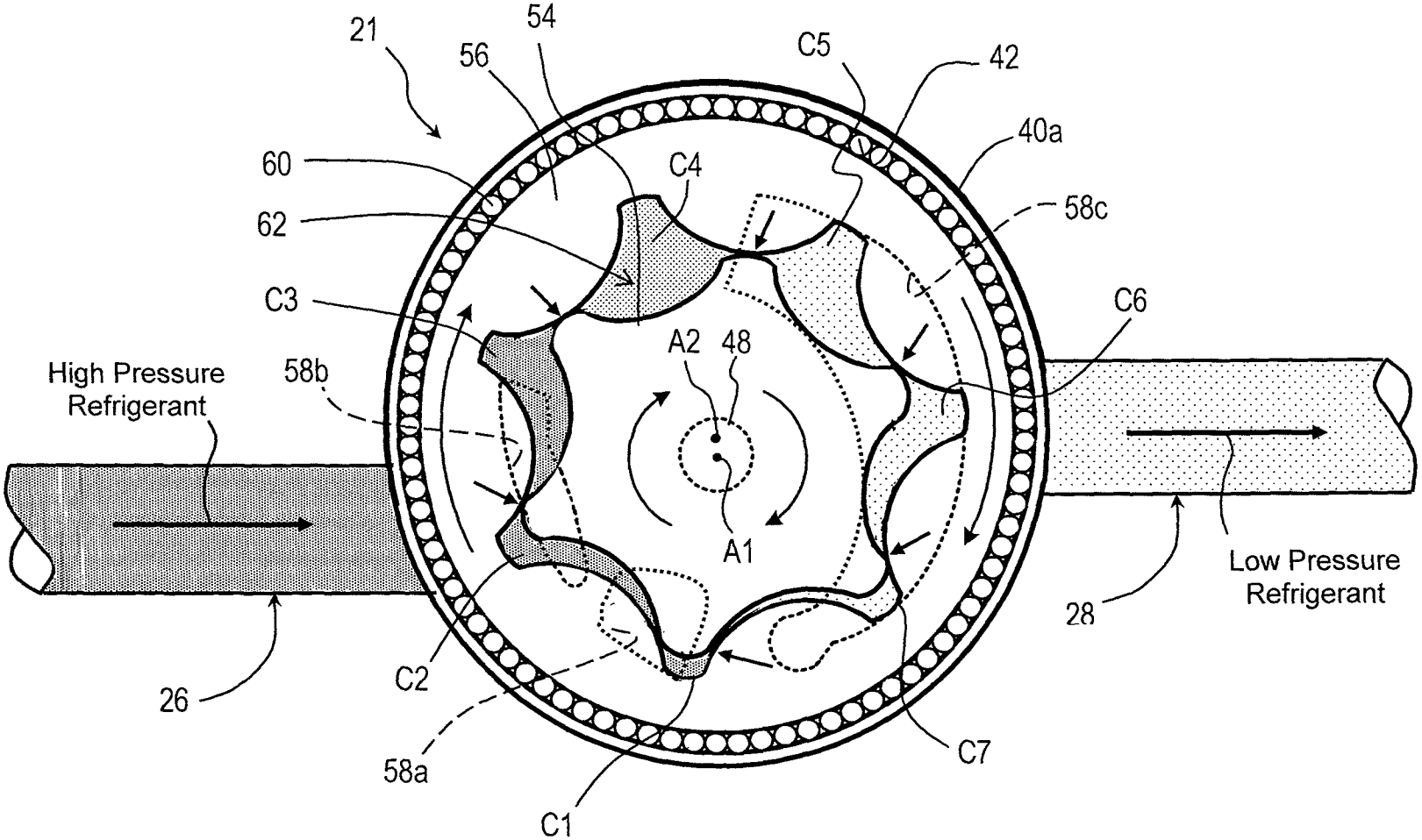
FIG. 7 is a simplified cross sectional view of the movable expander as seen along section line 6-6 in FIG. 3 illustrating relative pressure levels as refrigerant passes through the movable expander and generates torque.

The outer ring gear 56 is rotatably supported in the first housing part 40*a* by an outer gear bearing 60. Thus, the outer ring gear 56 rotates inside of the first housing part 40*a*. As seen in FIGS. 6 and 7, the outer ring gear 56 has an interior surface that defines a gear-shaped inner cavity 62 comprising seven teeth. The center gear 54 is disposed within the gear-shaped inner cavity 62, with a rotation axis A1 of the center gear 54 being offset from a rotation axis A2 of the outer ring gear 56 such that rotational movement of the outer ring gear 56 drives the center gear 54. Since the outer ring gear 56 has seven teeth, the center gear 54 is provided with six teeth. In other words, if the outer ring gear 56 has N number of teeth then the center gear 54 will have N−1 number of teeth. The teeth of the center gear 54 are meshed with the teeth of the outer ring gear 56 to divide the gear-shaped inner cavity 62 of the outer ring gear 56 into a plurality of isolated expansion cavities C1 to C7. The six small arrows in FIG. 7 indicate the contact points between the center gear 54 and the outer ring gear 56 to divide the gear-shaped inner cavity 62 into the isolated expansion cavities C1 to C7. Thus, the center gear 54 and the outer ring gear 56 are arranged to define the isolated expansion cavities C1 to C7 that move as the center gear 54 and the outer ring gear 56 rotate.

As the outer ring gear 56 rotates, lobes of the outer ring gear 56 that conform in shape and size with the concave portions between the teeth of the center gear 54 make contact with the center gear 54 causing it to rotate (see, six small arrows indicating the contact points in FIG. 7). By connecting the center gear 54 to the output shaft 48, work can be extracted from the air conditioning system 12. The gears 54 and 56 are oriented such that compressed refrigerant enters the gear-shaped inner cavity 62 between the outer ring gear 56 and the center gear 54 at the point where the volume between the gears 54 and 56 is smallest. Upon further rotation of the gears 54 and 56, as the volume between the gears 54 and 56 nears a maximum value, the refrigerant is allowed to expand before exiting the housing 40. The gears 54 and 56 are arranged within the gerotor expander chamber 42 with respect to the axis of the output shaft 48 such that a first axial side of the gears 54 and 56 receives high pressure refrigerant entering the gerotor expander chamber 42 of the movable expander 21 and such that the first axial side of the gears 54 and 56 discharges low pressure refrigerant exiting the gerotor expander chamber 42 of the movable expander 21. However, it should be understood that the gears 54 and 56 could alternatively be arranged within the gerotor expander chamber 42 such that high pressure refrigerant enters into and exits from opposite axial sides of the gears 54 and 56.

The flow control plate 58 controls the flow refrigerant into and out of the gear-shaped inner cavity 62 between the outer ring gear 56 and the center gear 54. In particular, the flow control plate 58 is fixed to the housing 40, and is basically provided with a first refrigerant input port 58*a*, a second refrigerant input port 58*b* and a refrigerant output port 58*c*. The first refrigerant input port 58*a* constitutes a first flow interface. The second refrigerant input port 58*b* constitutes a second flow interface. The second flow interface (e.g., the second refrigerant input port 58*b*) has a cross-sectional area that is larger than a cross-sectional area of the first flow interface (e.g., the first refrigerant input port 58*a*). The refrigerant output port 58*c* constitutes a third flow interface. The third flow interface (e.g., the refrigerant output port 58*c*) has a cross-sectional area that is larger than a cross-sectional area of the second flow interface (e.g., the second refrigerant input port 58*b*).

The first flow interface (e.g., the first refrigerant input port 58*a*) is disposed between the inlet 44 of the housing 40 and the gerotor expander chamber 42. Thus, the high pressure refrigerant continuously enters the gerotor expander chamber 42 through the first flow interface during operation of the air conditioning system 12. The second flow interface (e.g., the second refrigerant input port 58*b*) is disposed between the inlet 44 of the housing 40 and the gerotor expander chamber 42 at a point downstream from the first flow interface (e.g., the first refrigerant input port 58*a*). However, unlike the first refrigerant input port 58*a*, the high pressure refrigerant only enters the gerotor expander chamber 42 through the second flow interface (e.g., the second refrigerant input port 58*b*) when the valve 22 is open. Thus, the high pressure refrigerant selectively enters the gerotor expander chamber 42 through the second flow interface.

The third flow interface (e.g., the refrigerant output port 58*c*) is disposed between the outlet 46 of the housing 40 and the gerotor expander chamber 42. Thus, the low pressure refrigerant exits the gerotor expander chamber 42 through the third flow interface. The refrigerant output port 58*c* is shaped to give the refrigerant a maximum opportunity to exit the gerotor expander chamber 42 of the housing 40 before the gears 54 and 56 come together again. In other words, the refrigerant output port 58*c* is shaped to avoid recompressing the expanded refrigerant. The third flow interface (e.g., the refrigerant output port 58*c*) spans at least two of the isolated expansion cavities C1 to C7 at a given time such that low pressure refrigerant is discharged from the at least two of the plurality of isolated expansion cavities C1 to C7 from the gerotor expander chamber 42 through the third flow interface (e.g., the refrigerant output port 58*c*).

The first refrigerant input port 58*a* defines a minimum flow path that permits refrigerant to flow into the gerotor expander chamber 42 while the valve 22 is closed so as to reduce suction losses in the air conditioning system 12. The first refrigerant input port 58*a* (i.e., minimum flow path) at the first flow interface fluidly connects the inlet 44 of the housing 40 to the gerotor expander chamber 42 to deliver high pressure refrigerant to the gerotor expander chamber 42 while the valve 22 is closed. More specifically, the first refrigerant input port 58*a* (i.e., minimum flow path) is arranged to continually deliver high pressure refrigerant to one of the plurality of isolated expansion cavities having a minimum volume at a given time.

The second refrigerant input port 58*b* defines a regulated flow path that is selectively opened and closed by operation of the valve 22. The regulated flow path is fluidly connected to the gerotor expander chamber 42 at the second flow interface (e.g., the second refrigerant input port 58*b*) which is disposed downstream from the first flow interface (e.g., the first refrigerant input port 58*a*) and upstream from third flow interface (e.g., the refrigerant output port 58*c*). The valve 22 effectively controls the flow rate of high pressure refrigerant flowing through the regulated flow path such that high pressure refrigerant entering the gerotor expander chamber 42 at the first and second flow interfaces from the minimum flow path and the regulated flow path expands and exits through the outlet 46 of the movable expander 21.

Figure 9:
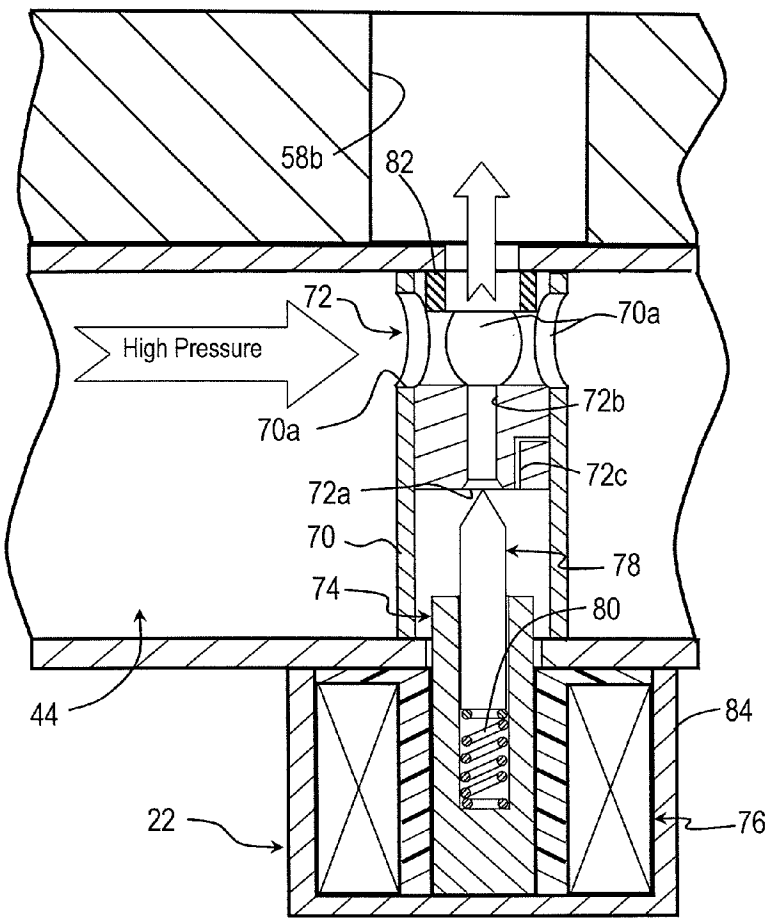
FIG. 9 is a simplified cross sectional view of the valve of the energy recovery device illustrated in FIGS. 1-7 in the open state.
Figure 8:
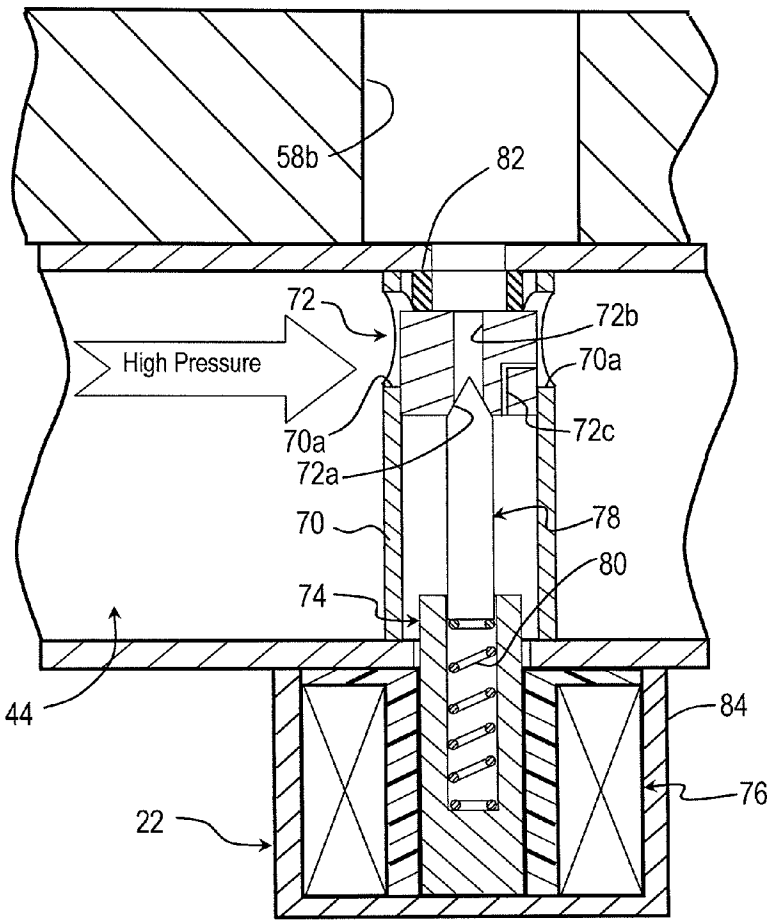
FIG. 8 is a simplified cross sectional view of the valve of the energy recovery device illustrated in FIGS. 1-7 in the closed state.

As best seen in FIGS. 8 and 9, the valve 22 is a normally closed solenoid valve that basically includes a cylinder 70, a piston 72, a fixed core 74, a coil 76, a movable core 78, a spring or biasing member 80 and a face seal 82. The valve 22 is designed so that the high pressure refrigerant enters the cylinder 70 of the valve 22 in a radial direction with respect to movement of the piston 72 and exits in an axial direction with respect to movement of the piston 72 in response to movement of the piston 72 from a closed position to an open position.

The cylinder 70 is fixedly disposed in the inlet 44 with the piston 72 slidably mounted within the interior of the cylinder 70. The cylinder 70 has a plurality of openings 70*a* that are selectively opened and closed by the piston 72 being moved between the closed and open positions. The piston 72 is biased to the normally closed position by the biasing member 80.

The valve 22 is configured to open in response to detection of a prescribed pressure condition of low pressure refrigerant downstream of the energy recovery device 14 that is indicative of a prescribed temperature condition existing. The valve 22 is configured to control a flow rate of high pressure refrigerant flowing from the inlet 44 to the gerotor expander chamber 42, and control the flow rate of high pressure refrigerant entering the gerotor expander chamber 42 through the regulated flow path defined by the second refrigerant input port 58*b*. The piston 72 constitutes a solenoid valve piston that contacts the face seal 82 at the end of its travel. Thus, when the piston 72 opens slightly, the high pressure flow can easily rush past an end of the piston 72 to the gerotor expander chamber 42.

The fixed core 74 and the movable core 78 are made of magnetic materials. The fixed core 74 and the coil 76 are fixed to the housing 40 by a valve body 84, while the movable core 78 is movably disposed with respect to the fixed core 74. Movement of the movable core 78 releases the sealing force of the piston 72 so that the piston 72 can move from contact with the face seal 82 due to the force from the high pressure refrigerant. The coil 76 excites or magnetizes the fixed core 74 by feeding an electrical current to the coil 76. The piston 72 is disposed opposite the face seal 82 so as to be seated thereon and working together with the face seal 82 as a valve portion for opening and closing a flow path of the high pressure refrigerant. The movable core 78 is disposed between the fixed core 74 and the piston 72 so as to advance and retreat the piston 72. The biasing member 80 is disposed between the fixed core 74 and the movable core 78. The biasing member 80 functions as a resilient biasing member for biasing the movable core 78 in the closing direction such that the piston 72 is seated on the face seal 82. The coil 76 is electrically connected to the control unit 30, which controls the current value to be supplied to the coil 76. The coil 76 generates an attracting force between the movable core 78 and the fixed core 74 by being energized, and causes the movable core 78 to retract in a valve-opening direction against the spring force of the biasing member 80 from the initial closed position.

The movable core 78 has a tapered tip, the end of which is brought into contact with a funnel-shaped opening 72*a* of a through bore 72*b* in the piston 72 to close the through bore 72*b* in the piston 72. In a demagnetized state where the coil 76 is not excited, the spring force of the biasing member 80 is set to a spring force level, at which the movable core 78 is sealed in a fluid-tight state with the funnel-shaped opening 72*a* of the through bore 72*b* in the piston 72 as well as the piston 72 being seated on the face seal 82 in a fluid-tight state. That is, the fixed core 74 and the movable core 78 are assembled together with the biasing member 80 placed therebetween and with a prescribed spring force generated to hold the piston 72 in a fluid-tight state with the face seal 82.

If a current is fed to the coil 76 under the control of the control unit 30 and the fixed core 74 is excited, then an attracting force is generated between the fixed core 74 and the movable core 78. This attracting force causes the movable core 78 to retract to the fixed core 74 side against the spring force of the biasing member 80. In this way, the movable core 78 is separated from the piston 72, which in turn releases the piston 72. The piston 72 is separated from the face seal 82 due to the high pressure refrigerant in the inlet 44 contacting and exerting force on the side of the piston 72 that is opposite the moveable core 78. Therefore, in a state where a current is fed to the coil 76, refrigerant freely flows from the inlet 44 into the gerotor expander chamber 42 through the regulated flow path. The piston 72 is also provided with a bleed path 72*c* that extends through the piston 72 for equalizing the pressure from the refrigerant on both sides of the piston 72.

Figure 10:
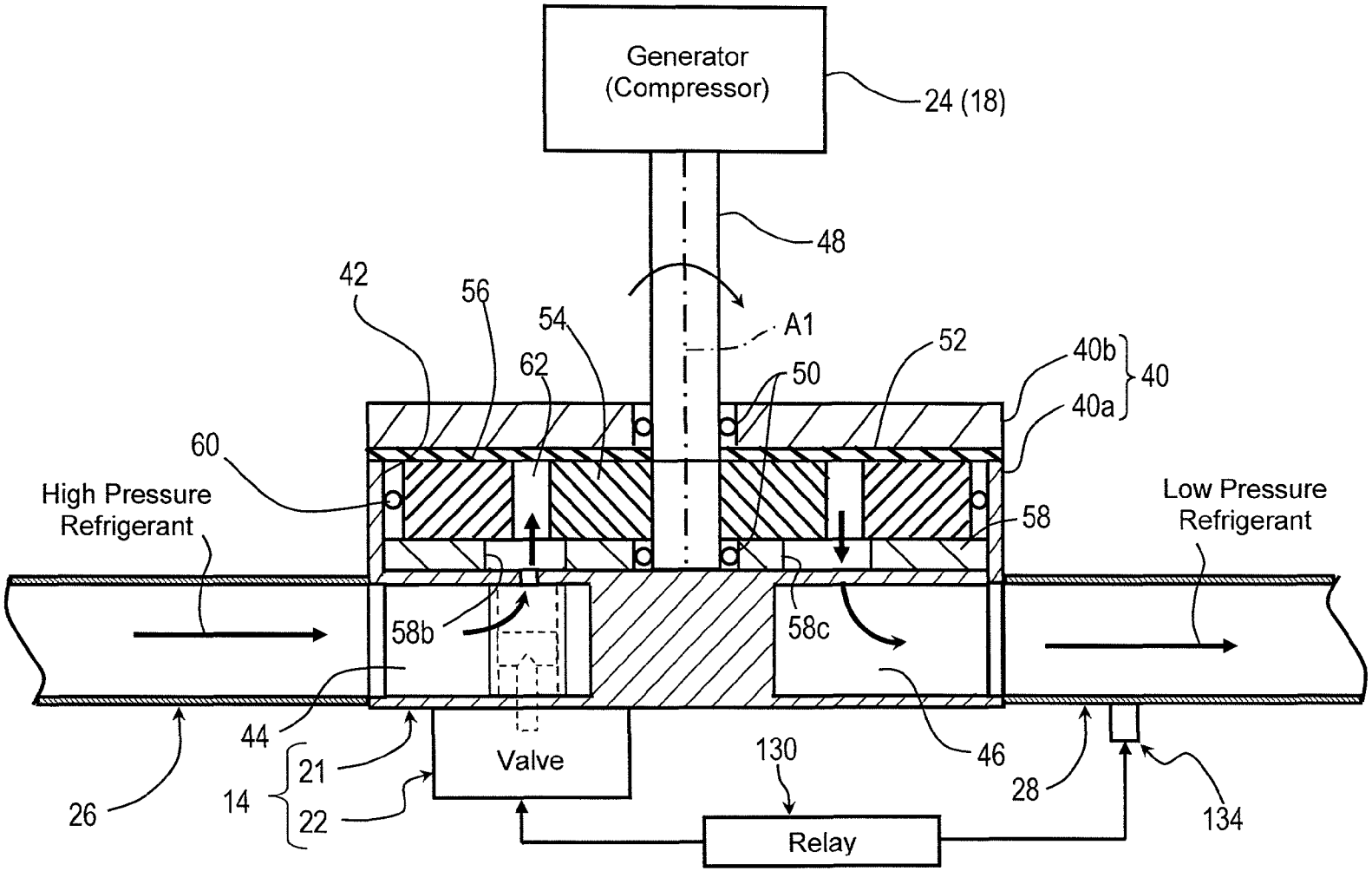
FIG. 10 is a simplified cross sectional view, similar to FIG. 4, of a movable (gerotor) expander in accordance with an alternate embodiment.

Referring now to FIG. 10, a simplified cross sectional view, similar to FIG. 4, of a movable (gerotor) expander 112 is illustrated in accordance with an alternate embodiment. In the embodiment of FIG. 10, a simple relay 130 and a pressure sensor 134 have been added for controlling opening and closing of the valve 22 instead of using the control unit 30 as in the prior embodiment. In view of the similarity between this embodiment and the prior embodiment, the parts of this embodiment that are identical to the parts of the prior embodiment will be given the same reference numerals as the parts of the prior embodiment. Moreover, the descriptions of the parts of this embodiment that are identical to the parts of the prior embodiment may be omitted for the sake of brevity. The parts of this embodiment that differ from the parts of the prior embodiment will be indicated a new reference numeral.

The relay 130 is operatively connected to the pressure sensor 134 to receive a control signal therefrom. The pressure sensor 134 is installed in the low pressure line 28. When the pressure in the low pressure line 28 falls below a prescribed level, the pressure sensor 134 provides a current or a voltage to the relay 130 allowing it to open the valve 22. Once the pressure within the low pressure line 28 has reached another prescribed level, the relay 130 shuts the valve 22. Hence, the valve 22 is connected to the relay 130, which is configured to open the valve 22 in response to prescribed pressure conditions sensed by the pressure sensor 134. Alternatively, the pressure sensor 34 can be used instead of adding a second pressure sensor.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. The terms of degree such as "substantially", "about" and "approximately" as used herein mean a reasonable amount of deviation of the modified term such that the end result is not significantly changed. Thus, the foregoing descriptions of the embodiments according to the present invention are provided for illustration only, and not for the purpose of limiting the invention as defined by the appended claims and their equivalents.

What is claimed is:

1. An air conditioning system comprising:

an evaporator;

a compressor fluidly connected to the evaporator to compress low-pressure refrigerant exiting the evaporator to high-pressure refrigerant;

a condenser fluidly connected to the compressor to receive the high pressure refrigerant and dissipate heat therefrom;

an energy recovery device configured to extract work from the high pressure refrigerant flowing therethrough, the energy recovery device including a gerotor expander and a valve, the gerotor expander having an inlet fluidly connected to the condenser to receive high pressure refrigerant exiting the condenser, an outlet fluidly connected to the evaporator to deliver low pressure refrigerant thereto and a chamber having an inlet side and an outlet side, the inlet side of the chamber of the gerotor expander including a minimum flow path and a regulated flow path, with the minimum flow path uninterruptedly fluidly connecting the inlet to the chamber to deliver high pressure refrigerant to the chamber, the valve being configured to control a flow rate of high pressure refrigerant entering the inlet side of the chamber from the inlet through the regulated flow path, and the outlet side of the chamber being fluidly connected to the outlet of the gerotor, the chamber including a center gear and a ring gear, a rotation axis of the center gear being offset from a rotation axis of the ring gear such that rotational movement of the ring gear drives the center gear.

2. The air conditioning system as set forth in claim 1, wherein the minimum flow path and the regulated flow path defining a flow interface between the inlet and the chamber with high pressure refrigerant entering the chamber through the flow interface, and the gerotor expander further includes an exit flow interface disposed between the outlet and the outlet side of the chamber with low pressure refrigerant exiting the chamber through the exit flow interface, the exit flow interface having a cross-sectional area that is larger than a cross-sectional area of the flow interface.

3. The air conditioning system as set forth in claim 1, wherein the regulated flow path is fluidly connected to the inlet side of the chamber downstream from the minimum flow path and upstream from the outlet.

4. The air conditioning system as set forth in claim 1, wherein the minimum flow path is fluidly connected to the inlet side of the chamber at a first flow interface, and the regulated flow path is fluidly connected to the inlet side of the chamber at a second flow interface having a larger cross-sectional area than the first flow interface.

5. The air conditioning system as set forth in claim 1, wherein the energy recovery device further includes a rotatable shaft connected to the center gear of the gerotor expander.

6. The air conditioning system as set forth in claim 5, wherein the rotatable shaft of the energy recovery device is configured and arranged to extract the work from rotational movement of the center gear.

7. The air conditioning system as set forth in claim 5, wherein the center gear rotates the rotatable shaft in a first direction about a center rotational axis of the rotatable shaft in response to a phase change of the flow of a refrigerant from the high pressure refrigerant at the inlet to the low pressure refrigerant at the outlet.

8. The air conditioning system as set forth in claim 5, further comprising a control unit operatively connected to the valve to control the flow rate of high pressure refrigerant exiting the condenser and entering the energy recovery device based on at least one of pressure and temperature of the air conditioning system.

9. The air conditioning system as set forth in claim 1, wherein the valve is configured to open in response to detection of a prescribed pressure condition of low pressure refrigerant downstream of the energy recovery device that is indicative of a prescribed temperature condition existing.

10. The air conditioning system as set forth in claim 1, wherein the energy recovery device is operatively coupled to the compressor to transfer work from expanding of the high pressure refrigerant flowing through the energy recovery device to the compressor.

11. The air conditioning system as set forth in claim 1, wherein the energy recovery device is operatively coupled to a generator to transfer work from expanding of the high pressure refrigerant flowing therethrough to the generator to produce electric current.

12. The air conditioning system as set forth in claim 1, wherein the minimum flow path is configured to deliver high pressure refrigerant to the chamber while the valve is closed.

13. The air conditioning system as set forth in claim 1, wherein the valve includes a solenoid operated piston.

14. The air conditioning system as set forth in claim 1, wherein the center gear has an end face that is coplanar with an end face of the ring gear.

15. The air conditioning system as set forth in claim 1, wherein the center gear has a first axial side that is arranged in the chamber such that the first axial side of the center gear receives high pressure refrigerant entering the chamber of the gerotor expander and such that the first axial side of the center gear discharges low pressure refrigerant exiting the chamber of the gerotor expander.

16. The air conditioning system as set forth in claim 1, wherein the center gear and the ring gear are arranged to define a plurality of isolated expansion cavities.

17. The air conditioning system as set forth in claim 1, wherein the outlet side of the chamber of the gerotor expander includes a flow interface that spans at least two of the plurality of isolated expansion cavities at a given time such that low pressure refrigerant is discharged from the at least two of the plurality of isolated expansion cavities from the chamber of the gerotor expander through the flow interface.

18. The air conditioning system as set forth in claim 1, wherein the center gear and the ring gear are arranged to define a plurality of isolated expansion cavities, with the minimum flow path being arranged to continually deliver high pressure refrigerant to one of the plurality of isolated expansion cavities having a minimum volume at a given time.

19. An air conditioning system comprising:

an evaporator;

a compressor fluidly connected to the evaporator to compress low-pressure refrigerant exiting the evaporator to high-pressure refrigerant;

a condenser fluidly connected to the compressor to receive the high pressure refrigerant and dissipate heat therefrom;

an energy recovery device configured to extract work from the high pressure refrigerant flowing therethrough, the energy recovery device including a movable expander and a valve, the movable expander having an inlet fluidly connected to the condenser to receive high pressure refrigerant exiting the condenser, an outlet fluidly connected to the evaporator to deliver low pressure refrigerant to the evaporator, and a chamber having an inlet side fluidly connected to the inlet and an outlet side fluidly connected to the outlet, the movable expander further includes a minimum flow path and a regulated flow path, with the minimum flow path fluidly connecting the inlet to the inlet side of the chamber at a first flow interface to deliver high pressure refrigerant to the chamber, and the regulated flow path fluidly connecting the inlet to inlet side of the chamber at a second flow interface downstream from the first flow interface and upstream from the outlet side of the chamber to deliver high pressure refrigerant to the chamber at the second flow interface, the valve being configured to control a flow rate of high pressure refrigerant flowing through the regulated flow path.

* * * * *